US009625850B2

(12) United States Patent
Ishino

(10) Patent No.: US 9,625,850 B2
(45) Date of Patent: Apr. 18, 2017

(54) IMAGE FORMING APPARATUS

(71) Applicant: KYOCERA Document Solutions Inc., Osaka-shi, Osaka (JP)

(72) Inventor: Masahito Ishino, Osaka (JP)

(73) Assignee: KYOCERA DOCUMENT SOLUTIONS INC., Osaka-Shi, Osaka (JP)

( * ) Notice: Subject to any disclaimer, the term of this patent is extended or adjusted under 35 U.S.C. 154(b) by 0 days.

(21) Appl. No.: 15/143,650

(22) Filed: May 2, 2016

(65) Prior Publication Data

US 2016/0334733 A1 Nov. 17, 2016

(30) Foreign Application Priority Data

May 15, 2015 (JP) ..... 2015-099620

(51) Int. Cl.
*G03G 15/02* (2006.01)
*G03G 15/06* (2006.01)

(52) U.S. Cl.
CPC ..... *G03G 15/065* (2013.01); *G03G 15/0266* (2013.01)

(58) Field of Classification Search
CPC ..... G03G 15/0266; G03G 15/065; G03G 2215/0119–2215/0148
See application file for complete search history.

(56) References Cited

U.S. PATENT DOCUMENTS 5,270,783 A 12/1993 Bisaiji et al.
2003/0206755 A1* 11/2003 Wright ..... G03G 15/168 399/303
2006/0098999 A1* 5/2006 Nishida ..... G03G 15/065 399/55
2006/0216071 A1* 9/2006 Yamada ..... G03G 15/0815 399/279
2006/0251449 A1* 11/2006 Takahashi ..... G03G 15/065 399/265
2010/0254725 A1* 10/2010 Uetake ..... G03G 15/065 399/55

FOREIGN PATENT DOCUMENTS

JP H05216337 A 8/1993
JP H06175472 A 6/1994

* cited by examiner

*Primary Examiner* — Sevan A Aydin

(57) ABSTRACT

A multifunction peripheral includes a transfer belt, a first imaging unit, a second imaging unit, a primary transfer roller, a secondary transfer roller, a developing bias application unit, a charging bias application unit, and a control unit. The control unit performs control such that a first developing bias that is applied to a first developing roller by the developing bias application unit and a a second developing bias that is applied to a second developing roller by the developing bias application unit have opposite phases.

7 Claims, 6 Drawing Sheets

IMAGE FORMING APPARATUS

INCORPORATION BY REFERENCE

The disclosure of Japanese Patent Application No. 2015-99620 filed on May 15, 2015, including the specification, drawings and abstract is incorporated herein by reference in its entirety.

BACKGROUND

This disclosure relates to an image forming apparatus.

In an image forming apparatus, such as a multifunction peripheral, an image of an original document is read out by an image reading unit, and then, a photoreceptor provided to an image forming unit is irradiated with light on the basis of the readout image to form an electrostatic latent image on the photoreceptor. Thereafter, a charged developer is fed by a developing apparatus onto the formed electrostatic latent image to form a visible image, the visible image is transferred to a sheet of paper and is fixed by a fixing unit provided to the image forming apparatus, and the sheet of paper is discharged to the outside of the apparatus.

Techniques related to an image forming apparatus including a developing apparatus have been conventionally known.

SUMMARY

Regarding concentration unevenness that occurs in forming a halftone image the concentration of which is uniform throughout an entire surface thereof, the present inventor focused on unevenness of electrification when a photoreceptor is electrified, and furthermore, found that there is the following tendency for the relationship between an charging bias and a developing bias. That is, the present inventor found that, in forming an image, a charging roller to which an charging bias is applied is provided in a position in vicinity of a developing roller to which a developing bias is applied, and therefore, if the developing bias that is applied to the developing roller that is adjacent to the charging roller is an alternating current bias, influences of electrostatic induction of the developing bias appear. Then, the present inventor conducted intensive examinations and arrived at a configuration according to the present disclosure.

That is, an image forming apparatus according to the present disclosure includes a transfer belt, a first imaging unit, a second imaging unit, a primary transfer roller, a secondary transfer roller, a developing bias application unit, a charging bias application unit, and a control unit. The transfer belt is configured to rotate in one direction, and a toner image is primarily transferred onto the transfer belt. The first imaging unit includes a first photoreceptor, a first developing roller that supplies a developer to the first photoreceptor, and a first charging roller that electrifies the first photoreceptor. The first imaging unit is configured to form a toner image, on the basis of an electrostatic latent image formed on a surface of the first photoreceptor. The second imaging unit is provided in a position that is adjacent to the first imaging unit in a rotation direction of the transfer belt. The second imaging unit includes a second photoreceptor, a second developing roller that is provided in a side that is closer to the first imaging unit, relative to the second photoreceptor, and supplies a developer to the second photoreceptor, and a second charging roller that is provided on a side that is opposite to a side on which the first imaging unit is provided, relative to the second photoreceptor, and electrifies the second photoreceptor. The second imaging unit forms a toner image, on the basis of an electrostatic latent image formed on a surface of the second photoreceptor. The primary transfer roller primarily transfers the toner images formed on the first and second photoreceptors to the transfer belt. The secondary transfer roller secondarily transfers the toner images primarily transferred to the transfer belt to a recording medium. The developing bias application unit applies an alternating current developing bias to the first and second developing rollers. The charging bias application unit applies a charging bias to the first and second charging rollers. The control unit performs control such that a first developing bias that is applied to the first developing roller by the developing bias application unit and a second developing bias that is applied to the second developing roller by the developing bias application unit have opposite phases.

DETAILED DESCRIPTION

Figure 1:
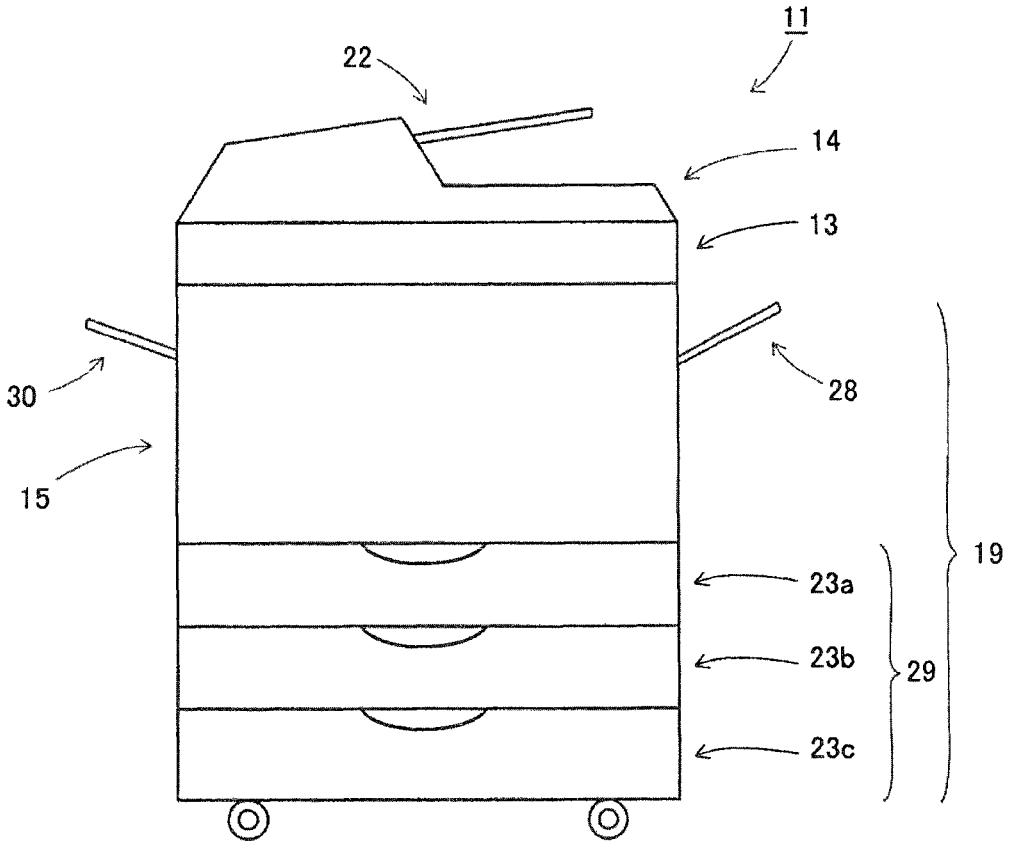
FIG. 1 is a view illustrating a multifunction peripheral achieved by applying an image forming apparatus according to an embodiment of the present disclosure to a multifunction peripheral.
Figure 2:
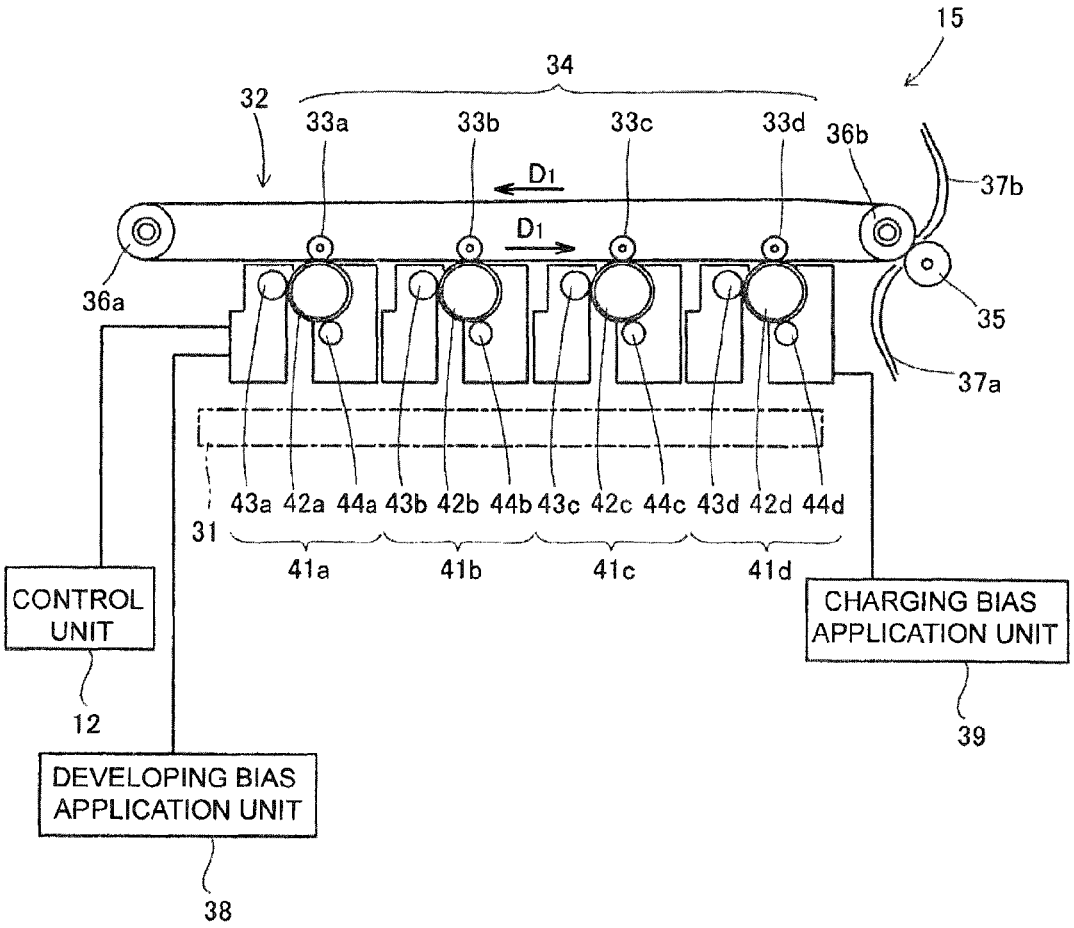
FIG. 2 is a view illustrating an image forming unit of a multifunction peripheral.
Figure 3:
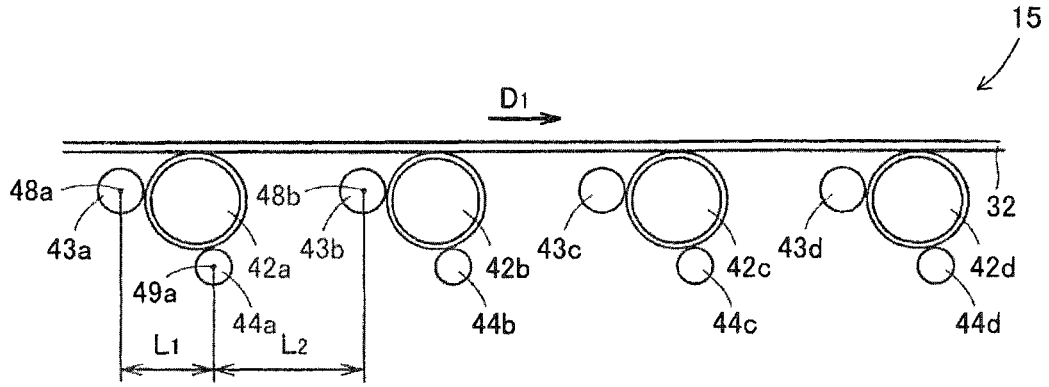
FIG. 3 is a view illustrating a simplified arrangement of members that form the image forming unit.

Embodiments of the present disclosure will be described below. FIG. 1 is a view illustrating a multifunction peripheral achieved by applying an image forming apparatus according to an embodiment of the present disclosure to a multifunction peripheral. FIG. 2 is a view illustrating an image forming unit 15 of a multifunction peripheral 11. FIG. 3 is a view illustrating a simplified arrangement of members that form the image forming unit 15.

With reference to FIG. 1 to FIG. 3, the multifunction peripheral 11 includes a control unit 12, an operation unit 13, an image reading unit 14, an image forming unit 15, a paper setting unit 19, and a discharging try 30.

The control unit 12 performs control of the entire multifunction peripheral 11. The operation unit 13 includes a display screen (not illustrated) configured to display information sent from the multifunction peripheral 11 side and input contents of a user. The operation unit 13 urges the user to input conditions, such as the number of print copies, gradation, and the like, for image forming, and on and off of a power supply source. The image reading unit 14 includes an auto document feeder (ADF) 22 as a document feeder configured to convey a document, which has been set in a set position, to a reading position. The image reading unit 14 reads out an image of the document that has been set on the ADF 22 or a mounting table. The paper setting unit 19 includes a manual paper feeding tray 28 in which paper is manually set and a paper cassette group 29 that is capable of storing a plurality of sheets of paper with different sizes. In the paper setting unit 19, a sheet of paper that is to be fed to the image forming unit 15 is set. The image forming unit 15 forms an image on a sheet of paper, which has been conveyed, on the basis of an image that has been read by the image reading unit 14 and image data transmitted via a network. The sheet of paper on which the image has been formed by the image forming unit 15 is discharged to the discharging try 30.

Next, a configuration of the image forming unit 15 of the multifunction peripheral 11 will be described in more detail.

The image forming unit 15 includes a first imaging unit 41*a*, a second imaging unit 41*b*, a third imaging unit 41*c*, and a fourth imaging unit 41*d* that correspond to four colors, that is, yellow, magenta, cyan, and black, respectively, a laser scanner unit (LSU) 31 serving as an exposing device, a transfer belt 32 serving as an intermediate transfer medium, a primary transfer unit 34 including four primary transfer rollers 33*a*, 33*b*, 33*c*, and 33*d* that are provided so as to correspond to the imaging unit 41*a*, 41*b*, 41*c*, and 41*d*, respectively, a secondary transfer roller 35, a developing bias application unit 38, and a charging bias application unit 39. The LSU 31 is schematically indicated by a chain line. Note that the multifunction peripheral 11 includes a so-called quadruple tandem type image forming unit 15.

The first imaging unit 41*a* that forms a yellow tonner image includes a first photoreceptor 42*a* that has a surface on which an electrostatic latent image is to be formed, a first developing roller 43*a* that supplies a yellow developer to the first photoreceptor 42*a*, and a first charging roller 44*a* that electrifies the first photoreceptor 42*a*. The second imaging unit 41*b* that forms a cyan tonner image includes a second photoreceptor 42*b* that has a surface on which an electrostatic latent image is to be formed, a second developing roller 43*b* that supplies a cyan developer to the second photoreceptor 42*b* and a second charging roller 44*b* that electrifies the second photoreceptor 42*b*. The third imaging unit 41*c* that forms a magenta toner image includes a third photoreceptor 42*c* that has a surface on which an electrostatic latent image is to be formed, a third developing roller 43*c* that supplies a magenta developer to the third photoreceptor 42*c*, and a third charging roller 44*c* that electrifies the third photoreceptor 42*c*. The fourth imaging unit 41*d* that forms a black toner image includes a fourth photoreceptor 42*d* that has a surface on which an electrostatic latent image is to be formed, a fourth developing roller 43*d* that supplies a black developer to the fourth photoreceptor 42*d*, and a fourth charging roller 44*d* that electrifies the fourth photoreceptor 42*d*.

The developing bias application unit 38 applies a developing bias to each of the first to fourth developing rollers 43*a* to 43*d*. The developing bias application unit 38 may apply both of an alternating current (AC) developing bias and a direct current (DC) developing bias. The developing bias application unit 38 may apply only an AC developing bias and also may apply a bias in a form in which a DC current is superimposed on an AC current. Also, the developing bias application unit 38 may separately apply a developing bias to each of the first to fourth developing rollers 43*a* to 43*d*. That is, for example, when applying an AC developing bias, the developing bias application unit 38 may cause the phase of a developing bias that is applied to the first developing roller 43*a* and the phase of a developing bias that is applied to the second developing roller 43*b* to be different from each other. Note that, if a developing bias has a configuration in which a DC bias is superimposed on an AC bias, the developing property of a toner may be precisely controlled, and therefore, this configuration is advantageous in view of image quality.

The charging bias application unit 39 applies a charging bias to each of the first to fourth charging rollers 44*a* to 44*d*. The charging bias application unit 39 may apply both of an alternating current (AC) developing bias and a direct current (DC) developing bias. Note that, as for the charging bias, only a DC charging bias is preferably applied. This is because reduction in scraping of a photoreceptor layer, that is, a photoreceptor film, as well as reduction in the amount of generated ozone, reduction in electrification sound, and elimination of frequency interference with development, may be achieved.

Figure 4:
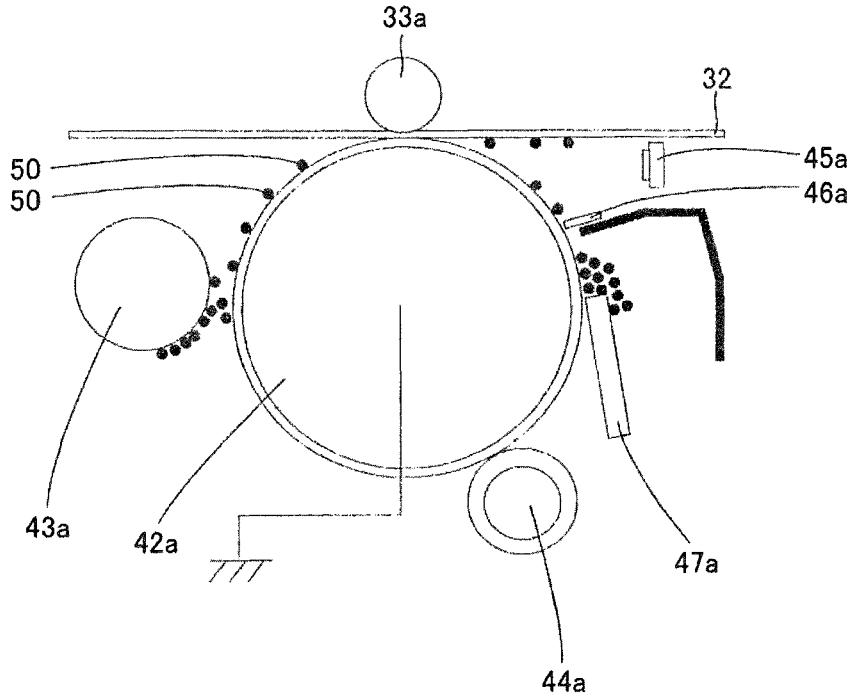
FIG. 4 is a view illustrating a configuration of a yellow imaging unit.

A configuration of the yellow imaging unit 41*a* will be described. FIG. 4 is a view illustrating a configuration of the yellow imaging unit 41*a*. With reference to FIG. 4, the yellow imaging unit 41*a* includes the first photoreceptor 42*a*, the first developing roller 43*a*, and the charging roller 44*a*, a first neutralization lamp 45*a*, a first toner seal 46*a*, and a first cleaning blade 47*a*. The first developing roller 43*a* moves a charged toner to a first photoreceptor 42*a* side by a high voltage, such as a developing bias. The first charging roller 44*a* is a roller which is provided with a conductive rubber around a metal shaft. The first charging roller 44*a* electrifies a surface of the first photoreceptor 42*a* by discharging in the vicinity of the surface with a charging bias, which is a voltage applied to the shaft. After a primary transfer is performed by the primary transfer roller 33*a*, the first neutralization lamp 45*a* neutralizes residual electric charges on the first photoreceptor 42*a*. After neutralization, the first cleaning blade 47*a* scoops out a toner 50 that remains on the first photoreceptor 42*a* to remove it. The first toner seal 46*a* is provided such that a toner that has been scooped out by the first cleaning blade 47*a* does not leak. Note that each of the cyan imaging unit 41*b*, the magenta imaging unit 41*c*, and the black imaging unit 41*d* has the same configuration as that of the yellow imaging unit 41*a*, and therefore, the description thereof will be omitted.

The first to fourth imaging units 41*a* to 41*d* are disposed in the order of yellow, cyan, magenta, and black from an upstream side in a rotation direction of the transfer belt 32, which is indicated by an arrow $D_1$ in FIG. 2 and FIG. 3. That is, from the upstream side, the first imaging unit 41*a*, the second imaging unit 41*b*, the third imaging unit 41*c*, and the fourth imaging unit 41*d* are disposed in this order. The fourth imaging unit 41*d* is disposed in a most downstream side.

Also, members that form the first to fourth imaging units 41*a* to 41*d* are disposed in the following arrangement. That is, the first developing roller 43*a* is provided on a side that is opposite to a side on which the second imaging unit 41*b* is provided, relative to the first photoreceptor 42*a*. The first charging roller 44*a* is provided on a side that is closer to the second imaging unit 41*b*, relative to the first photoreceptor 42*a*. The second developing roller 43*b* is provided on a side that is closer to the first imaging unit 41*a*, relative to the second photoreceptor 42*b*. The second charging roller 44*b* is provided on a side that is opposite to a side on which the first imaging unit 41*a* is provided, relative to the second photoreceptor 42*b*. The third developing roller 43*c* is provided on a side that is closer to the second imaging unit 41*b*, relative to the third photoreceptor 42*c*. The third charging roller 44*c* is provided on a side that is opposite to a side on which the second imaging unit 41*b* is provided, relative to the third photoreceptor 42*c*. The fourth developing roller 43*d* is provided on a side that is closer to the third imaging unit 41*c*, relative to the fourth photoreceptor 42*d*. The fourth charging roller 44*d* is provided on a side that is opposite to a side on which the third imaging unit 41*c* is provided, relative to the fourth photoreceptor 42*d*.

For the first imaging unit 41*a*, a distance between the first developing roller 43*a* and the first charging roller 44*a* in the rotation direction of the transfer belt 32 is set to be shorter than a distance between the first charging roller 44*a* and the second developing roller 43*b*. That is, assuming that a distance between the center 48*a* of the first developing roller 43*a* and the center 49*a* of the first charging roller 44*a* is $L_1$ and a distance between the center 49*a* of the first charging roller 44*a* and the center 48*b* of the second developing roller 43*b* is $L_2$, the distance $L_1$ and the distance $L_2$ are set such that $L_1<L_2$ is achieved. Specifically, as $L_1$, 200 mm is selected, and as $L_2$, 400 mm is selected. Note that the relationship between each of the other developing rollers 43*b*, 43*c*, and 43*d* and the corresponding one of the other charging rollers 44*b*, 44*c*, and 44*d* is the same as the above-described relationship.

Each of the first to fourth charging rollers 44*a* to 44*d* electrifies the corresponding one of the first to fourth photoreceptors 42*a* to 42*d* to a predetermined potential. The LSU 31 causes each of the first to fourth photoreceptors 42*a* to 42*d* to be exposed with light, on the basis of the image that has been read by the image reading unit 14. An electrostatic latent image is formed on each of the first to fourth photoreceptors 42*a* to 42*d*, on the basis of light of a component of the corresponding one of the colors, with which the first to fourth photoreceptors 42*a* to 42*d* has been exposed. A developer, that is, specifically, a toner, of each color is supplied from the corresponding one of the first to fourth developing rollers 43*a* to 43*d* to the corresponding one of the electrostatic latent images formed on the first to fourth photoreceptors 42*a* to 42*d*. The toner of each color is supplied to the corresponding one of the first to fourth photoreceptors 42*a* to 42*d*, and a toner image of each color is formed on the corresponding one of the first to fourth photoreceptors 42*a* to 42*d*. Thus, the toner images formed on the first to fourth photoreceptors 42*a* to 42*d* are primarily transferred to the transfer belt 32.

The transfer belt 32 is in an endless form. The transfer belt 32 is caused to rotate in one direction by a driving roller 36*a* and a driven roller 36*b*. The rotation direction of the transfer belt 32 is indicated by the arrow $D_1$ in FIG. 2 and FIG. 3. That is, the rotation direction of the transfer belt 32 is a direction from the left side to the right side in a lower area in which the first to fourth photoreceptors 42*a* to 42*d* are provided, and a direction from the right side to the left side in an opposite area, that is, an upper area. In the rotation direction of the transfer belt 32, among the first to fourth imaging units 41*a* to 41*d*, the first imaging unit 41*a* that forms a yellow toner image is disposed in a most upstream side, and the fourth imaging unit 41*d* that forms a black toner image is disposed in the most downstream side. Note that the transfer belt 32 rotates from the upstream side to the downstream side.

Each of the four primary transfer rollers 33*a* to 33*d* is disposed in a position that is opposed to the corresponding one of the photoreceptors 42*a* to 42*d* of the corresponding color via the transfer belt 32. The toner images that have been formed by the first to fourth imaging units 41*a* to 41*d* of four colors, that is, yellow, magenta, cyan, and black, are primarily transferred to the transfer belt 32 by a primary transfer unit 34. Specifically, a primary transfer bias is applied to each of the primary transfer rollers 33*a* to 33*d*, and thereby, the toner images that have been formed by the first to fourth imaging units 41*a* to 41*d* are primarily transferred to a surface of the transfer belt 32. At this time, the image of each color is superimposed on the transfer belt 32, and thus, a full color image is formed on the transfer belt 32.

The secondary transfer roller 35 is provided in a position that is opposed to the driven roller 36*b* via the transfer belt 32. The image forming unit 15 includes a paper conveyance path 37*a* through which a sheet of paper as a recording medium is conveyed to a position in which the secondary transfer roller 35 and the surface of the transfer belt 32 contact each other. Also, the image forming unit 15 includes a paper conveyance path 37*b* through which a sheet of paper to which an image has been secondarily transferred is conveyed to a fixing unit side (not illustrated). A sheet of paper is supplied from the paper conveyance path 37*a* that is located on an upstream side on which paper cassettes 23*a* to 23*c* are located to the position in which the secondary transfer roller 35 and the surface of the transfer belt 32 contact each other. In accordance with a timing at which the sheet of paper is conveyed, a secondary transfer bias of an opposite polarity to that of the toner supplied to the secondary transfer roller 35 is applied. Due to application of the secondary transfer bias to the secondary transfer roller 35, a toner image that has been formed on the surface of the transfer belt 32 is electrically drawn to a side of the sheet of paper which has been fed and is secondarily transferred to the sheet of paper. The sheet of paper to which the toner image has been transferred is conveyed to the fixing unit (not illustrated) using the paper conveyance path 37*b*.

In this case, in forming an image, an AC developing bias is applied to each of the first to fourth developing rollers 43*a* to 43*d* by the developing bias application unit 38. Also, a DC charging bias is applied to each of the first to fourth charging rollers 44*a* to 44*d* by the charging bias application unit 39. The control unit 12 performs control such that a first developing bias that is applied to the first developing roller 43*a* by the developing bias application unit 38 and a second developing bias that is applied to the second developing roller 43*b* by the developing bias application unit 38 have opposite phases. Also, in forming an image, the control unit 12 performs control such that a third developing bias that is applied to the third developing roller 43*c* by the developing bias application unit 38 and the second bias have opposite phases and a fourth developing bias that is applied to the fourth developing roller 43*d* by the developing bias application unit 38 and the third developing bias have opposite phases. That is, in this case, the first developing bias and the second developing bias have opposite phases, the first developing bias and the third developing bias have the same phase, and the second developing bias and the fourth developing bias have the same phase.

Figure 5:
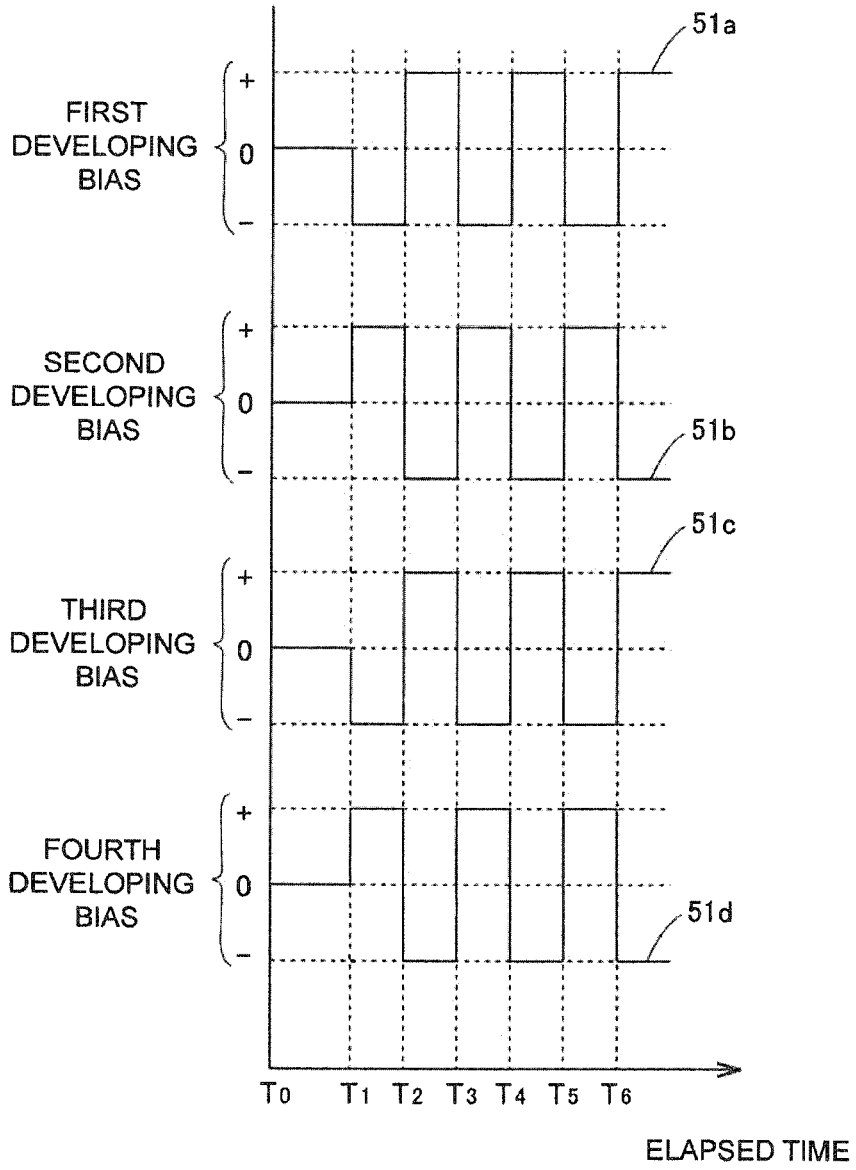
FIG. 5 is a graph illustrating the relationship between a developing bias that is applied to each of first to fourth developing rollers in forming an image and an elapsed time.

FIG. 5 is a graph illustrating the relationship between a developing bias that is applied to each of the first to fourth developing rollers 43*a* to 43*d* in forming an image and an elapsed time. In FIG. 5, the abscissa axis denotes an elapsed time and the ordinate axis denotes a developing bias that is applied. The first developing bias that is applied to the first developing roller 43*a* is indicated by a line 51*a*. The second developing bias that is applied to the second developing roller 43*b* is indicated by a line 51*b*. The third developing bias that is applied to the third developing roller 43*c* is indicated by a line 51*c*. The fourth developing bias that is applied to the fourth developing roller 43*d* is indicated by a line 51*d*.

With reference to FIG. 5, image formation starts at a time T0, and, from a time $T_1$, an AC developing bias is applied to each of the first to fourth developing rollers 43*a* to 43*d* by the developing bias application unit 38. In this case, as indicated by the lines 51*a* to 51*d*, a negative developing bias is applied to the first developing roller 43*a* from the time $T_1$ to a time $T_2$. On the other hand, a positive developing bias is applied to the second developing roller 43*b* from the time $T_1$ to the time $T_2$. Also, a negative developing bias is applied to the third developing roller 43*c* from the time $T_1$ to the time $T_2$. On the other hand, a positive developing bias is applied to the fourth developing roller 43*d* from the time $T_1$ to the time $T_2$.

When the elapsed time reaches the time $T_2$, a positive developing bias is applied to the first developing roller 43*a* from the time $T_2$ to a time $T_3$ this time. On the other hand, a negative developing bias is applied to the second developing roller 43*b* from the time $T_2$ to the time $T_3$ this time. Also, a positive developing bias is applied to the third developing roller 43*c* from the time $T_2$ to the time $T_3$. On the other hand, a negative developing bias is applied to the fourth developing roller 43*d* from the time $T_2$ to the time $T_3$.

When the elapsed time reaches the time $T_3$, a negative developing bias is applied again to the first developing roller 43*a* from the time $T_3$ to the time $T_4$. On the other hand, a positive developing bias is applied again to the second developing roller 43*b* from the time $T_3$ to a time $T_4$. Also, a negative developing bias is applied again to the third developing roller 43*c* from the time $T_3$ to the time $T_4$. On the other hand, a positive developing bias is applied again to the fourth developing roller 43*d* from the time $T_3$ to the time $T_4$.

As described above, when the elapsed time reaches each of the time $T_4$, a time $T_5$, and a time $T_6$, the polarity of a developing bias is alternately switched between the positive polarity and the negative polarity and the developing bias application unit 38 applies the developing bias to each of the developing rollers 43*a* to 43*d*. Application of the developing bias is continuously performed until image formation ends.

In the above-described multifunction peripheral 11, control is performed such that the first developing bias that is applied to the first developing roller 43*a* by the developing bias application unit 38 and the second developing bias that is applied to the second developing roller 43*b* by the developing bias application unit 38 have opposite phases, and therefore, influences of electrostatic induction that the first charging roller 44*a* disposed between the first developing roller 43*a* and the second developing roller 43*b* receives from the first developing roller 43*a* side and the second developing roller 43*b* side may be reduced. Therefore, unevenness of electrification in electrifying the first photoreceptor 42*a* may be reduced and image quality may be increased. Similarly, influences of electrostatic induction that the second charging roller 44*b* disposed between the second developing roller 43*b* and the third developing roller 43*c* receives from the second developing roller 43*b* side and the third developing roller 43*c* side may be reduced. Also, influences of electrostatic induction that the third charging roller 44*c* disposed between the third developing roller 43*c* and the fourth developing roller 43*d* receives from the third developing roller 43*c* side and the fourth developing roller 43*d* side may be reduced. Accordingly, unevenness of electrification in electrifying the first to third photoreceptors 42*a* to 42*c* may be reduced and image quality may be increased.

In this case, even when each of the first to fourth photoreceptors 42*a* to 42*d* is a photoreceptor of a positively-charged single layer type OPC, in which it is said that concentration unevenness tends to occur relatively often, the occurrence of concentration unevenness may be reduced and image quality may be increased.

Also, in this case, even when each of the first to fourth photoreceptors 42*a* to 42*d* is a photoreceptor with a thickness of 30 μm, in which it is said that concentration unevenness tends to occur relatively often, the occurrence of concentration unevenness may be reduced and image quality may be increased. Accordingly, the thickness of a photoreceptor layer of each of the first to fourth photoreceptors 42*a* to 42*d* may be at least 20 μm or more and 40 μm or less, and more preferably, 25 μm or more and 35 μm or less, so that image quality may be increased.

Figure 6:
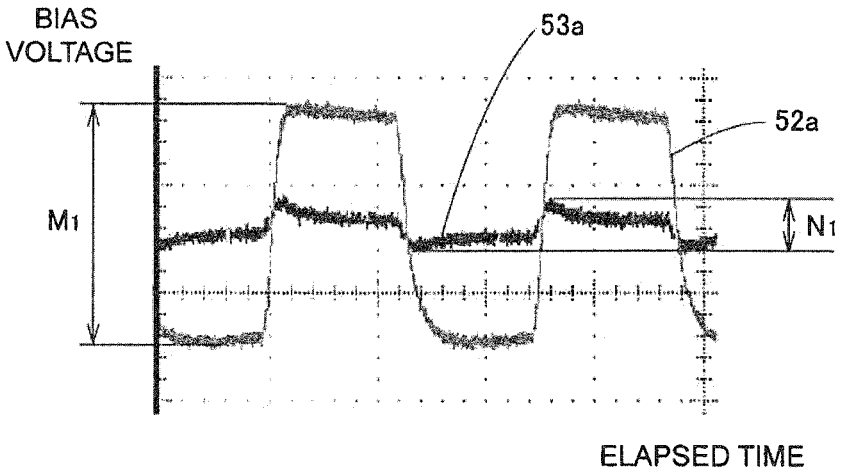
FIG. 6 is a graph achieved by measuring a developing bias that was applied to the second developing roller and a charging bias that was applied to a second charging roller and plotting measurement results.
Figure 7:
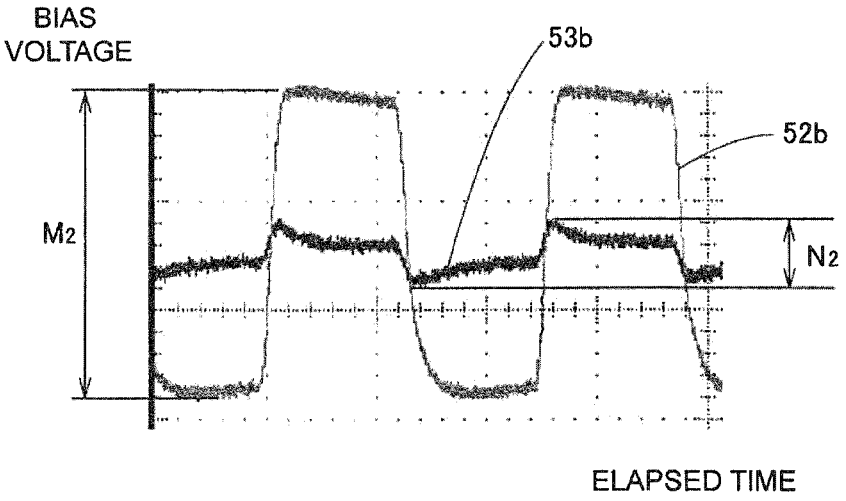
FIG. 7 is a graph achieved by measuring a developing bias that was applied to the second developing roller and a charging bias that was applied to the second charging roller and plotting measurement results.

Next, influences of electrostatic induction will be described. Each of FIG. 6 and FIG. 7 is a graph achieved by measuring a developing bias that was applied to the second developing roller 43*b* and a charging bias that was applied to a second charging roller 44*b* and plotting measurement results. In the cases illustrated in FIG. 6 and FIG. 7, AC developing biases having the same phase are applied to all of the first to fourth developing rollers 43*a* to 43*d*. In FIG. 6, the second developing bias is indicated by a line 52*a*, and the second charging bias that is applied to the second electrification roller 44*b* is indicated by a line 53*a*. In FIG. 7, the second developing bias is indicated by a line 52*b*, and the second charging bias is indicated by a line 53*b*.

Note that test conditions in this case are as follows. As the multifunction peripheral 11, a modified machine of TASKalfa 2550Ci manufactured by Kyocera Document Solutions Ltd. is used. Also, as for conditions for image formation, a system speed is 160 mm/second, each of the first to fourth photoreceptors 42*a* to 42*d* is a positively-charged single layer type organic photoconductor (OPC) drum (ϕ30 mm, a thickness of 30 μm, a photoreceptor layer binding resin molecular weight of 55000), each of the first to fourth charging rollers 44*a* to 44*d* is a roller made of epichlorohydrin rubber with ϕ12 mm, a voltage that is applied by the charging bias application unit 39 is a DC constant voltage of +1400 V, a surface potential is +500 V, a developing method is a two-component developing method employing AC and DC bias application development, a voltage that is applied by the developing bias application unit 38 is a DC voltage of +320 V (two types, that is, 1 kVpp (peak to peak) and 1.35 kVpp, 3.2 KHz), and the cleaning blade 47*a* is made of urethane rubber and has a thickness of 2.0 mm (the JIS-A hardness is 75 degrees, the impact resilience is 30% at 23° C., and a Young's modulus is 9.5 MPa).

First, with reference to FIG. 6, in this case, an AC developing bias is applied in predetermined cycles. In FIG. 6, Vpp indicated by a length $M_1$ is 1.0 kV. In this case, although a DC charging bias is applied, the charging bias increases and reduces with an amplitude indicated by a length $N_1$ in FIG. 6. The amplitude is 27 V.

Next, with reference to FIG. 7, in this case, an AC developing bias is applied in predetermined cycles. In FIG. 7, Vpp indicated by a length $M_2$ is 1.35 kV. In this case, although a DC charging bias is applied, the charging bias increases and reduces with an amplitude indicated by a length $N_2$ in FIG. 7. The amplitude is 32 V.

A relationship between the amplitude of a charging bias and the level of concentration unevenness will be described. Table 1 is a table illustrating a relationship between the amplitude of a charging bias and the level of concentration unevenness. In Table 1, "POOR" represents a case in which concentration unevenness has clearly occurred in each of a high temperature and high humidity environment in which the temperature is 32° C. and the humidity is 80%, a normal temperature and normal humidity environment in which the temperature is 23° C. and the humidity is 50%, and a low temperature and low humidity environment in which the temperature is 10° C. and the humidity is 15%. "INFERIOR" represents a case in which concentration unevenness has not occurred in the high temperature and high humidity environment but concentration unevenness has clearly occurred in each of the normal temperature and normal humidity environment and the low temperature and low humidity environment. "GOOD" represents a case in which concentration unevenness has not occurred in each of the high temperature and high humidity environment and the normal temperature and normal humidity environment but concentration unevenness has slightly occurred in the low temperature and low humidity environment. "EXCELLENT" represents a case in which concentration unevenness has not occurred in any one of the high temperature and high humidity environment, the normal temperature and normal humidity environment, and the low temperature and low humidity environment. Note that, as compared to the other environments, in the low temperature and low humidity environment, influences of a transfer bias tend to remain in a photoreceptor layer, and therefore, concentration unevenness tends to occur.

TABLE 1

| AMPLITUDE (V) OF CHARGING BIAS | LEVEL OF CONCENTRATION UNEVENNESS |
|---|---|
| 30 | POOR |
| 27 | INFERIOR |
| 22 | INFERIOR |
| 18 | GOOD |
| 14 | GOOD |
| 10 | EXCELLENT |
| 5 | EXCELLENT |
| 3 | EXCELLENT |
| 0 | EXCELLENT |

With reference to Table 1, in the case illustrated in FIG. 7, that is, a case in which the amplitude of the charging bias is 32 V, the level of concentration unevenness is "POOR". Also, in the case illustrated in FIG. 6, that is, a case in which the amplitude of the charging bias is 27 V, the level of concentration unevenness is "INFERIOR".

On the other hand, in the case in which the above-described configuration of FIG. 5 is employed, that is, a case in which a configuration in which the control unit 12 performs control such that the first developing bias and the second developing bias have opposite phases, the first developing bias and the third developing bias have the same phase, and the second developing bias and the fourth developing bias have the same phase is employed, the amplitude of the charging bias is 18 V and the level of concentration unevenness is "GOOD".

Note that, in the above-described embodiment, control may be performed such that the fourth developing bias that is applied by the fourth developing roller 43*d* located in the most downstream side is smaller than the first, second, and third developing biases. Thus, influences of electrostatic induction of the fourth charging roller 44*d* that receives less influences of offset by an opposite phase may be reduced. In this case, for the fourth charging roller 44*d*, because a developing roller is not provided in the downstream side thereof, a probability that the charging bias increases and reduces is also low, the degree of increase and reduction in charging bias is low, and concentration unevenness hardly occurs.

Also, although, in the above-described embodiment, the distance between the first developing roller 43*a* and the first charging roller 44*a* is shorter than the distance between the first charging roller 44*a* and the second developing roller 43*b* in the rotation direction of the transfer belt 32, a configuration according to the present disclosure is not limited thereto, and the distance between the first developing roller 43*a* and the first charging roller 44*a* and the distance between the first charging roller 44*a* and the second developing roller 43*b* may be equal to each other in the rotation direction of the transfer belt 32.

Figure 8:
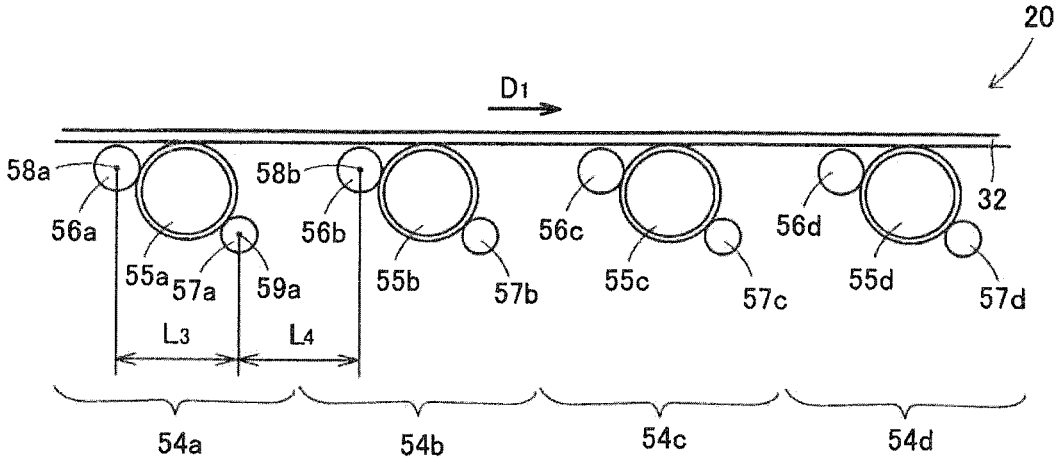
FIG. 8 is a view illustrating a simplified arrangement of members that form an image forming unit of a multifunction peripheral according to another embodiment of the present disclosure.

FIG. 8 is a view illustrating a simplified arrangement of members that form an image forming unit 20 in the above-described case. FIG. 8 corresponds to FIG. 3.

With reference to FIG. 8, the image forming unit 20 of a multifunction peripheral according to another embodiment of the present disclosure includes a first imaging unit 54*a* that forms a yellow toner image, a second imaging unit 54*b* that forms a cyan toner image, a third imaging unit 54*c* that forms a magenta toner image, and a fourth imaging unit 54*d* that forms a black toner image. The first imaging unit 54*a* includes a first photoreceptor 55*a* that has a surface on which an electrostatic latent image is to be formed, a first developing roller 56*a* that supplies a developer to the first photoreceptor 55*a*, and a first charging roller 57*a* that electrifies the first photoreceptor 55*a*. The second imaging unit 54*b* includes a second photoreceptor 55*b* that has a surface on which an electrostatic latent image is to be formed, a second developing roller 56*b* that supplies a developer to the second photoreceptor 55*b*, and a second charging roller 57*b* that electrifies the second photoreceptor 55*b*. The third imaging unit 54*c* includes a third photoreceptor 55*c* that has a surface on which an electrostatic latent image is to be formed, a third developing roller 56*c* that supplies a developer to the third photoreceptor 55*c*, and a third charging roller 57*c* that electrifies the third photoreceptor 55*c*. The fourth imaging unit 54*d* includes a fourth photoreceptor 55*d* that has a surface on which an electrostatic latent image is to be formed, a fourth developing roller 56*d* that supplies a developer to the fourth photoreceptor 55*d*, and a fourth charging roller 57*d* that electrifies the fourth photoreceptor 55*d*.

In this case, for the first imaging unit 54*a*, a distance between the first developing roller 56*a* and the first charging roller 57*a* is equal to a distance between the first charging roller 57*a* and the second developing roller 56*b* in the rotation direction of the transfer belt 32. That is, assuming that a distance between the center 58*a* of the first developing roller 56*a* and the center 59*a* of the first charging roller 57*a* is $L_3$ and a distance between the center 59*a* of the first charging roller 57*a* and the center 58*b* of the second developing roller 56*b* is $L_4$, the distance $L_3$ and the distance $L_4$ are set such that $L_3=L_4$ is achieved. Specifically, as each of $L_3$ and $L_4$, 300 mm is selected. Note that the relationship between each of the other developing rollers 56*b*, 56*c*, and 56*d* and the corresponding one of the other charging rollers 57*b*, 57*c*, and 57*d* is similar to the above-described relationship. For example, as compared to the case illustrated in FIG. 3, in the rotation direction of the transfer belt 32, each of the first to fourth developing rollers 56*a* to 56*d* is moved to a position that is closer to the corresponding one of the first to fourth charging rollers 57*a* to 57*d*, and also, each of the first to fourth charging rollers 57*a* to 57*d* is moved in a direction in which the distance from the center of the corresponding one of the first to fourth photoreceptors 55*a* to 55*d* increases, and thereby, the above-described configuration may be realized.

With reference to Table 1, again, when the control unit 12 performs control such that the first developing bias and the second developing bias have opposite phases, the first developing bias and the third developing bias have the same phase, and the second developing bias and the fourth developing bias have the same phase, and thus, the arrangement configuration illustrated in FIG. 9 is achieved, the amplitude of the charging bias is 3 V and the level of concentration unevenness is "EXCELLENT".

As has been described, with the multifunction peripheral 11 having the above-described configuration, image quality may be increased.

Note that, in the above-described embodiment, control may be performed such that the fourth developing bias that is applied by the first developing roller 43*a* located in the most downstream side is smaller than the first, second, and third developing biases. Thus, influences of electrostatic induction of the fourth charging roller 44*d* that receives less influences of offset by an opposite phase may be reduced.

Also, although, in the above-described embodiment, the first imaging unit 41*a* is a yellow imaging unit and the second imaging unit 41*b* is a cyan imaging unit, the first imaging unit 41*a* and the second imaging unit 41*b* are not limited thereto, and may be imaging units of the other adjacent colors.

The embodiments and examples disclosed herein are provided merely for illustrative purpose in every respect and are not intended to be limiting in any aspect. The scope of the present disclosure is defined by the scope of claims rather than the above-described description, and is intended to include any modifications within the scope and meaning equivalent to the terms of the claims.

An image forming apparatus according to the present disclosure may be effectively used specifically when increase in image quality is desired.

What is claimed is:

1. An image forming apparatus comprising:

a transfer belt configured to rotate in one direction;

a first imaging unit including a first photoreceptor, a first developing roller that supplies a developer to the first photoreceptor, and a first charging roller that electrifies the first photoreceptor and configured to form a toner image, on the basis of an electrostatic latent image formed on a surface of the first photoreceptor;

a second imaging unit provided in a position that is adjacent to the first imaging unit in a rotation direction of the transfer belt, including a second photoreceptor, a second developing roller that is provided on a side that is closer to the first imaging unit, relative to the second photoreceptor, and supplies a developer to the second photoreceptor, and a second charging roller that is provided on a side that is opposite to a side on which the first imaging unit is provided, relative to the second photoreceptor, and configured to form a toner image, on the basis of an electrostatic latent image formed on a surface of the second photoreceptor;

a plurality of primary transfer rollers configured to primarily transfer the toner images formed on the first and second photoreceptors to the transfer belt;

a second transfer roller configured to secondarily transfer the toner images primarily transferred to the transfer belt to a recording medium;

a developing bias application unit configured to apply an alternating current developing bias to the first and second developing rollers at the start of image formation;

a charging bias application unit configured to apply a charging bias to the first and second charging rollers; and a control unit configured to perform control such that a first developing bias that is applied to the first developing roller by the developing bias application unit and a second developing bias that is applied to the second developing roller by the developing bias application unit have opposite phases.

2. The image forming apparatus according to claim 1, wherein in the rotation direction of the transfer belt, a distance between the first developing roller and the first charging roller and a distance between the first charging roller and the second developing roller are equal to each other.

3. The image forming apparatus according to claim 1, wherein the charging bias that is applied by the charging bias application unit is a direct current bias.

4. The image forming apparatus according to claim 1, wherein each of the first photoreceptor and the second photoreceptor is a positively-charged single layer type organic photoconductor (OPC).

5. The image forming apparatus according to claim 4, wherein each of respective thicknesses of photoreceptor layers of the first photoreceptor and the second photoreceptor is 20 μm or more and 40 μm or less.

6. The image forming apparatus according to claim 1, further comprising:

a third imaging unit provided in a position that is adjacent to the second imaging unit on a side that is opposite to a side on which the first imaging unit is provided in the rotation direction of the transfer belt, and including a third photoreceptor that has a surface on which an electrostatic latent image is to be formed, a third developing roller that is provided in a side that is closer to the second imaging unit, relative to the third photoreceptor, and supplies a developer to the third photoreceptor, and a third charging roller that is provided on a side that is opposite to a side on which the second imaging unit is provided, relative to the third photoreceptor, and electrifies the third photoreceptor; and a fourth imaging unit provided in a position that is adjacent to the third imaging unit on a side that is opposite to a side on which the second imaging unit is provided in the rotation direction of the transfer belt, and including a fourth photoreceptor that has a surface on which an electrostatic latent image is to be formed, a fourth developing roller that is provided in a side that is closer to the third imaging unit, relative to the fourth photoreceptor, and supplies a developer to the fourth photoreceptor, and a fourth charging roller that is provided on a side that is opposite to a side on which the third imaging unit is provided, relative to the fourth photoreceptor, and electrifies the fourth photoreceptor, wherein the developing bias application unit applies an alternating current developing bias to the third and fourth developing rollers at the start of image formation, the charging bias application unit applies a charging bias to the third and fourth charging rollers, and the control unit performs control such that a third developing bias that is applied to the third developing roller by the developing bias application unit and the second developing bias have opposite phases and a fourth developing bias that is applied to the fourth developing roller by the developing bias application unit and the third developing bias have opposite phases.

7. The image forming apparatus according to claim 6, wherein the fourth imaging unit is disposed in a most downstream side in the rotation direction of the transfer belt, and the control unit performs control such that the fourth developing bias is smaller than the first, second, and third developing biases.

* * * * *